US005282351A

United States Patent [19]

Tetenborg

[11] Patent Number: 5,282,351

[45] Date of Patent: Feb. 1, 1994

[54] METHOD FOR MAKING, FILLING AND SEALING SACKS

[75] Inventor: Konrad Tetenborg, Lengerich, Fed. Rep. of Germany

[73] Assignee: Windmoeller & Hoelscher, Lengerich, Fed. Rep. of Germany

[21] Appl. No.: 970,994

[22] Filed: Nov. 3, 1992

[51] Int. Cl.[5] ..... B65B 43/04; B65B 41/12

[52] U.S. Cl. ..... 53/459; 53/452; 53/567

[58] Field of Search ..... 53/452, 451, 450, 459, 53/567, 551, 554

[56] References Cited

U.S. PATENT DOCUMENTS

| | | | |
|---|---|---|---|
| 4,784,697 | 11/1988 | Bordini | 53/451 X |
| 4,860,522 | 8/1989 | Cherney | 53/451 |
| 4,913,765 | 4/1990 | Tetenborg et al. | 53/253 X |
| 4,996,825 | 3/1991 | Bacon et al. | 53/451 |
| 5,172,536 | 12/1992 | Miyahara | 53/459 X |

FOREIGN PATENT DOCUMENTS

| | | |
|---|---|---|
| 21463A1 | 5/1980 | European Pat. Off. . |
| 2950553 | 7/1981 | Fed. Rep. of Germany . |
| 3007246 | 9/1981 | Fed. Rep. of Germany . |
| 1238169 | 7/1971 | United Kingdom . |

*Primary Examiner*—James F. Coan
*Attorney, Agent, or Firm*—Keck, Mahin & Cate

[57] ABSTRACT

The invention relates to a method for making, filling and sealing sacks from a tubular film web of thermoplastic material preferably provided with side folds and printed in format print, where the leading end of the tubular film web is each provided with a transverse weld, and from the tubular film web a section constituting an open sack is cut off, and where the sack is then filled and the open end of the sack is sealed by a transverse weld. For the solution of the object to provide a method of this kind, where it is ensured that the filled sacks are always filled tight and full, it is provided that corresponding to the filling level of the sack the length of the formed tubular film web sections is varied, that after making the transverse weld sealing the sack the tubular film web is intermittently advanced up to a printed mark, that the section constituting the sack is cut off by means of a separating cut without at the same time forming the transverse weld sealing the tube section, that the succeeding tubular film web is again advanced by a comparatively short adjustable length, that alternatively the advanced section of the tubular film web is cut off again, and that the transverse weld sealing the succeeding tube section is formed.

7 Claims, 5 Drawing Sheets

METHOD FOR MAKING, FILLING AND SEALING SACKS

Figure 1:
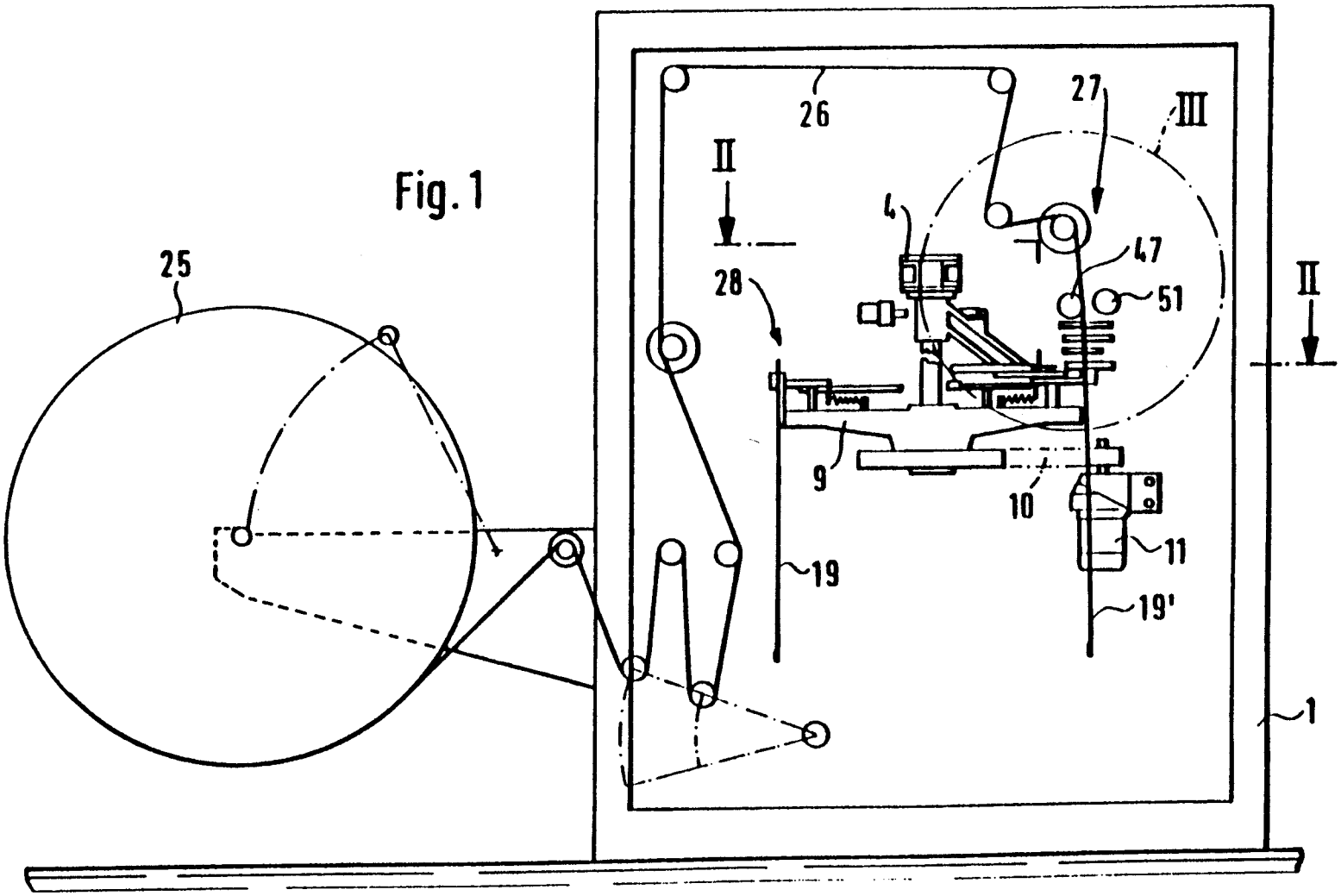

The invention relates to a method for making, filling and sealing sacks from a tubular film web of thermoplastic material preferably provided with side folds and printed in format print, where the leading end of the tubular film web is each provided with a transverse weld, and from the tubular film web a section forming an open sack is cut off, and where the sack is then filled and the open end of the sack is closed by a transverse weld.

Such methods are largely known in the prior art. For instance, the sections that will later on constitute the sack are withdrawn from a tubular chain in accordance with a known method. Said tubular chain is perforated at predetermined distances, so that the sections corresponding to the future sack can accordingly be torn off along the perforation. After closing the bottom weld the individual tube sections are supplied to the charging hopper for filling, for instance, with granular material. When a predetermined quantity of the material has been filled in, the open sacks are removed, are pulled taut at their open ends, and are sealed in a special trimming means.

However, generic method can for instance also be performed by means of an apparatus in accordance with the DE-OS 37 15 685. This apparatus comprises sliding and advancing rollers, by means of which each leading end of the tubular film web provided with a transverse weld is pushed in vertical direction freely hanging down, each intermittent by one length of bag or sack, between welding jaws of a welding device making opening and closing movements in a horizontal plane. Below the welding jaws a transverse cutting means is disposed, and below said transverse cutting means grippers arranged in pairs on a transport means are provided, which supply the hanging bags or sacks cut off from the tubular film web and provided with bottom welds in horizontal conveying direction via a cooling line for cooling the transverse welds to a transfer means transporting the same to a filling station. Said transport means consists of a hub-like supporting member, which is pivotally mounted about a vertical axis, with radial arms at whose free ends the grippers arranged in pairs are provided. The cooling line consists of a cooling carrousel, which supplies the sack workpieces provided with transverse welds and cut off from the tubular web from the welding station on a circular path to a means for transferring the sack workpieces to the filling station. When this apparatus comprises, for instance, four radial arms, there is provided above the first station a welding means as well as a cutting means. In accordance with this prior art each cycle of making a sack comprises the steps of introducing from the top a sack already provided with a transverse weld into the first pair of open grippers, and seizing and cutting off the same after it has been advanced by one length of sack. Then, a new transverse weld is formed at the end of the tubular web, while the cooling carrousel intermittently rotates about an angle of 90° and remains in this position until a further sack provided with a transverse weld has been introduced in the succeeding station. In a four-arm cooling carrousel this is repeated until the first station has rotated by 270° in three cycles. At this point the transverse weld has cooled and the sack is transferred to a transfer means for transporting the sack to a filling station, where after filling the sack a further transverse weld is made for sealing the filled sack, after the open end of the sack has been pulled taut.

In the filling station the sack is filled with a predetermined quantity of filling material, where in general a predetermined weight of filling material is filled in. However, the filling material, for instance a granular material to be filled in, has different bulk volumes with the same weight. This is, for instance, due to a different moisture content of the bulk material. Due to the different filling levels it can now occur that the sack, after it has been sealed by the transverse weld, has an undesired clearance between the same and the filling material. This means that the sacks are not filled tight, which is in particular disadvantageous in the further handling of the sacks.

When carrying out the generic method by means of an apparatus in accordance with the DE-OS 37 15 685 there is in addition the problem that an adjustment of the trimming means disposed in the same apparatus is not provided, so that depending on the bulk density of the filling material the sacks are—as desired—filled tight or are, however, filled with an undesired amount of excess air between the filling material and the sealing transverse weld.

It is the object of the present invention to develop the generic method such that it is ensured that all sacks can be filled tight and full, i.e. without undesired dead volume.

In accordance with the invention, proceeding from a generic method, the object is solved in that corresponding to the filling level of the sack the length of the formed tubular film web sections is varied already, that after forming the transverse weld sealing the sack the tubular film web is intermittently advanced up to a printed mark, that the section constituting the sack is cut off by means of a separating cut without simultaneous formation of the transverse weld sealing the succeeding tubular film section, that the succeeding tubular film web is again advanced by a comparatively short adjustable length, that alternatively the advanced section of the tubular film web is cut off again, and that the transverse weld sealing the succeeding tubular section is formed. This invention is based on the knowledge that the bulk properties of the filling material do not change abruptly. When the operating personnel detects that due to a change of the bulk density the bulk volume of the filling material has changed, the operator varies the length of the formed tubular film web sections by a corresponding adjustment of the sliding and advancing rollers of the apparatus advancing the tubular film web, and adapts said length to the respective filling level of the filling material in the sack. By means of the method in accordance with the invention it is now advantageously avoided that by varying the length of each formed tubular film web section the tubular film web is cut through at a printed point. It is decisive that the tubular film web is always advanced up to a printed mark at the opening edge of the sack to be cut off, that it is cut off then, and that in accordance with the length of the section to be formed the bottom weld of the succeeding section is varied by the operator in accordance with the setting as a result of the filling level. Depending on the filling level of the filling material there is formed a tubular film web section a few centimeters long, which can be collected separately and can be recycled. Alternatively, said tubular film web section, in particular when it only has a very small width, can remain at the sack as an excess length.

In accordance with a further embodiment of the invention the above-described intermediate advance of the tubular film web after cutting off the sack section can be set at zero for the case that the bulk material reaches its minimum bulk density to be expected and thus a maximum bulk level. This is the case, for instance, in the completely dry condition of a granular material to be filled in. In this case, when cutting off the leading sack section the transverse weld of the succeeding sack section can be formed at the same time, as here the maximum available length of the tubular film web section is utilized.

When during the cutting off and forming of the transverse welds, corners are welded off at the same time, as this is known for instance from the EP-A 00 21 463, it should be considered that in this case the corners of the opening edge of the leading bag and the corners at the bottom weld of the succeeding bag section cannot simultaneously be formed by means of a tool, as this would for instance be easily possible in a tubular film web with scattered print. Therefore, in accordance with a further advantageous embodiment of the present invention the welding of corners at the opening edge of the sack section and at the bottom seam is each made by means of a separate corner welding tool. Corresponding to the length of the intermediate section the section can then manually or automatically be readjusted between the separate corner welding tools. Advantageously, all corner welds can be formed together with the transverse weld sealing the succeeding tubular section.

Alternatively, the welding of corners at the opening edge of the sack section can be made together with the separating cut, and the welding of corners at the bottom seam can be made together with the formation of the transverse weld. In this method variant it is, however, accepted that the duration of the method sequence is comparatively longer, as in the case of welding corners at the opening edge of the sack section while at the same time making the separating cut, the speed is now no longer determined by the time required for cutting the web, but by the time required for welding the corners. For the case that the intermediate advance is set at zero, both tools are advanced to the tubular film web at the same time.

Figure 2:
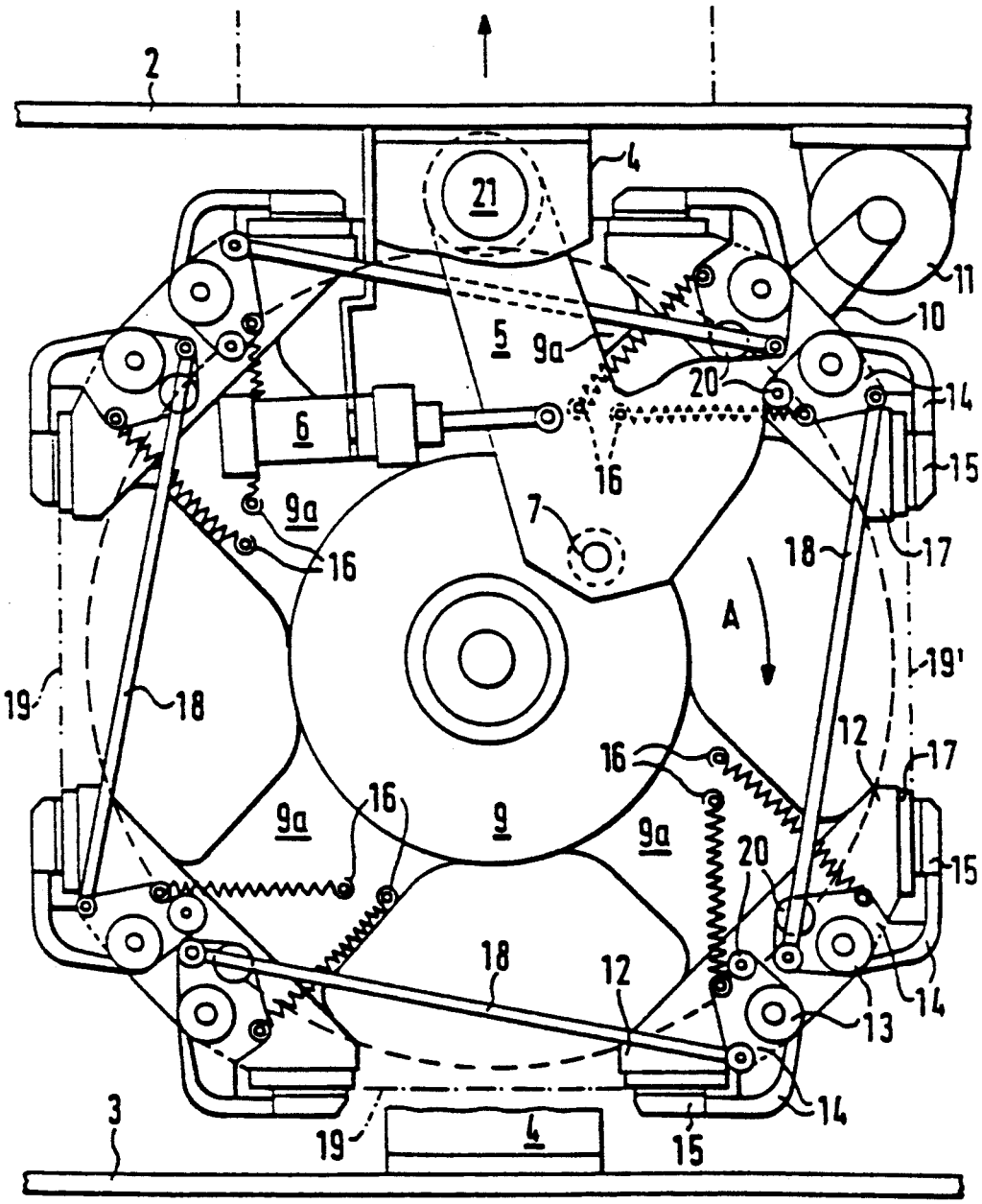
Figure 3:
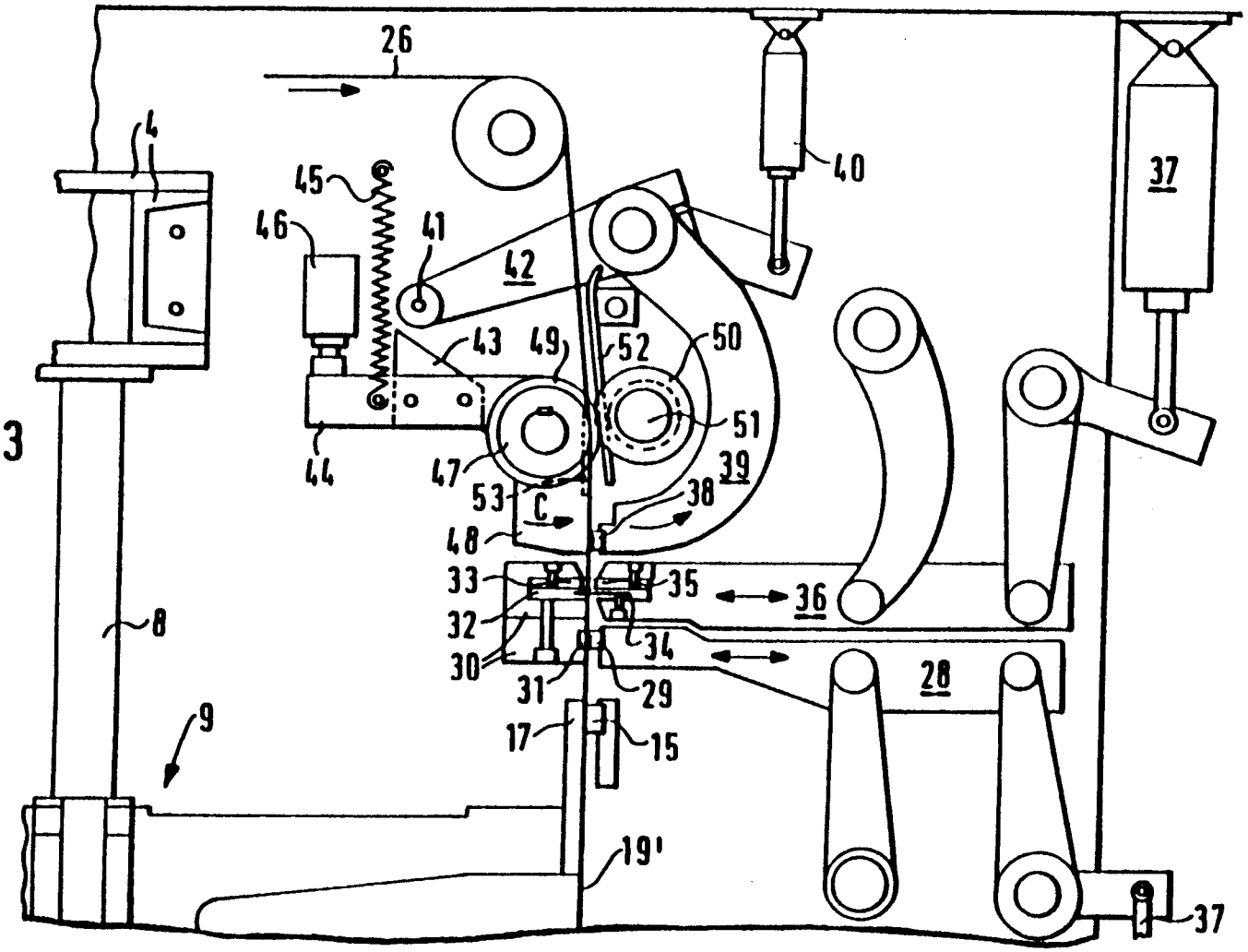
Figure 4:
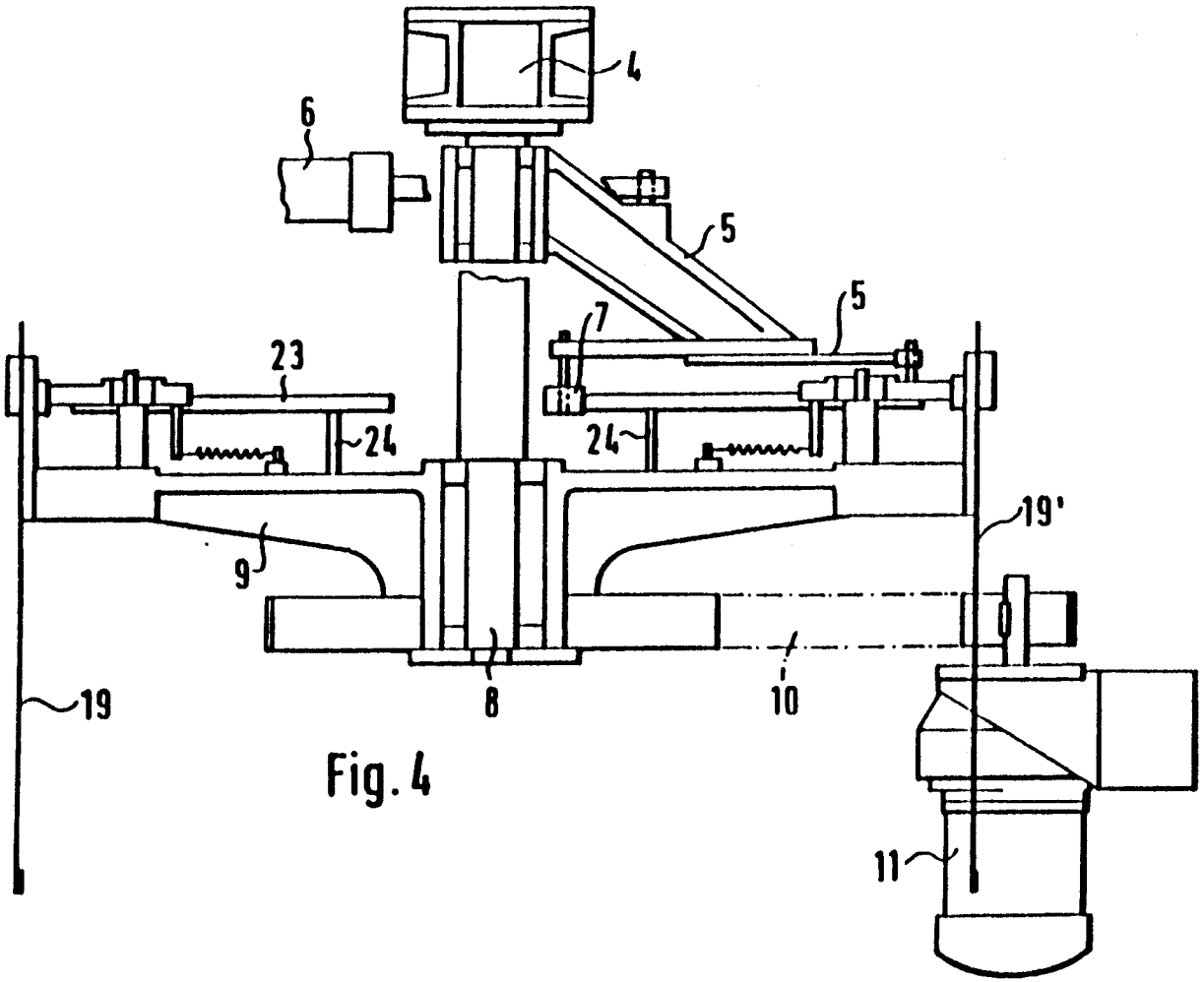
Figure 5:
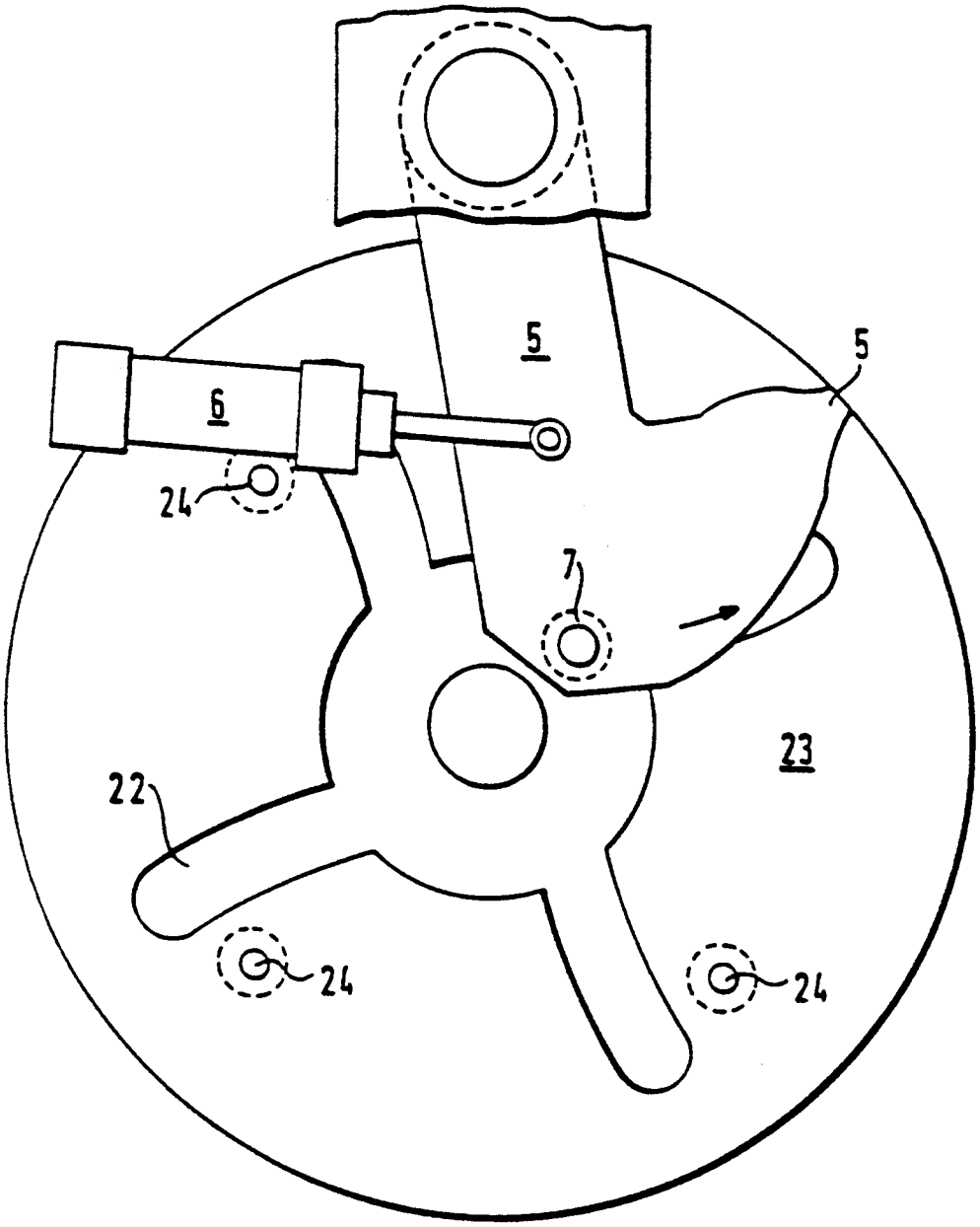

An embodiment of the invention will subsequently be described in detail by means of the drawing, wherein:

FIG. 1 shows an apparatus for carrying out the method in accordance with the invention for making bags or sacks comprising a cooling carrousel in a schematic side view, FIG. 2 shows a section through the apparatus along line II—II in FIG. 1, FIG. 3 shows the portion circled in FIG. 1 with a dash-dotted line in an enlarged representation, FIG. 4 shows the middle portion of the apparatus in accordance with FIG. 1 in an enlarged representation, and FIG. 5 shows the locking plate in accordance with FIG. 4 in a top view.

A frame 1 comprises side walls 2 and 3, which are indicated in FIG. 2. Both side walls 2, 3 are connected with each other by a crossbar 4. Said crossbar 4 is about centrally provided with a downwardly extending fixed axis 21, on which in the vicinity of the crossbar 4 a swivel arm 5 is mounted, which by means of a fluid piston cylinder unit 6, whose cylinder is stationarily held by a supporting member, can be moved in one of two possible end positions.

In FIG. 5 it can be seen that the swivel arm 5 designed as angle lever carries a shaped part 5' at its free end, and in its angle sector is provided with a retaining roller 7. The function of these parts will be discussed further below in the description.

Furthermore, to the crossbar 4 a further vertical axis 8 is attached, which below the swivel arm 5 carries a four-arm rotary table 9, which by means of a toothed belt 10 can be intermittently rotated by a motor 11 by 90° each. The direction of rotation of the rotary table is indicated in FIG. 2 by an arrow A.

From FIG. 2 it can be seen that the freely protruding arms 9*a* of the rotary table 9 constituting a hub, so to speak, comprise shaped parts 12 each provided with two upwardly projecting pins 13. Pivotally mounted about each pin 13 is a lever 14, which at its free end constitutes a gripper 15. Each of said grippers rests against an abutment surface 17 by the force of the springs 16, with each shaped part being provided with two abutment surfaces 17. By one connecting rod 18 the levers 14 facing each other of two adjacent arms 9*a* are functionally connected with each other such that the two associated grippers 15 open or close simultaneously, so as to be able, for instance, to seize and hold a sack 19.

The grippers 15 are opened by the wedge- or curve-shaped cam surfaces of the shaped part 5' of the supporting arm 5. When the supporting arm 5 is swivelled by extending the piston rod of the fluid piston cylinder unit 6, the shaped part 5' is urging apart the pressure rollers 20 of the shaped part 12 connected with the levers 14, so that the grippers 15 swivel about the pins 13 and move away from the associated abutment surfaces 17. By means of the connecting rods 18 the grippers 15 of adjacent shaped parts are released at the same time. In the position represented in FIG. 2 the gripper units 15 pointing to the upper edge of the drawing and those pointing to the right edge of the drawing would be released upon actuation of the fluid piston cylinder unit 6.

To ensure that in the case of an undesired starting of the motor 11 by the protruding shaped part 5' no damage occurs, the retaining roller 7 mounted in the angle sector of the swivel arm 5 moves into a guiding groove 22 of a locking plate 23 when the swivel arm is swivelled for opening the grippers. Said locking plate 23 is firmly connected with the rotary table 9 by means of screw bolts 24, so that said rotary table is prevented from rotating by the retaining roller 7 of the swivel arm 5, namely as long as the shaped part 5' is present between the rollers 20 of a shaped part 12.

From FIG. 1 it can be seen that from a roller 25 a tube 26 moves into an inlet station 27. Said inlet station 27 is stationarily connected with the framelike support 1 and is represented in detail in FIG. 3. FIG. 3 shows the central axis 8 of the cooling carrousel and a part of the rotary table 9. Clamped between the grippers 15 and the abutment surfaces 17 of the rotary table 9 is a tube section 19 provided with a bottom seam, which is, however, still connected with the tubular web 26. Above the grippers 15 and 17 there is provided a coupling rod 28 guided in parallel on connecting rods, which at its end facing the web 26 carries a clamping strip 29, which cooperates with a counter-strip 31 fixed in a stationary support 30. In addition to the counter-strip 31 the support 30 comprises a knife receiving groove 32 as well as a welding jaw 33. For cutting off the sack 19 from the tubular web 26 a knife 34 falls into the knife receiving groove 32, while a second welding jaw 35 cooperates with the welding jaw 33, so as to provide the leading end of the tubular web 26 with a transverse weld.

The tubular web 26 is printed in format print. In this case it is important that the print is not cut through when the tube sections are formed. Therefore, the advance of the tubular web is effected intermittently by means of a printed mark provided at the opening edge of the respective sack. Changing the length of the sack section is now effected by the corresponding operator in that a longer or shorter strip is cut off between the opening edge of the bag section and the bottom weld of the succeeding sack section. These tubular web sections cut off can then be collected and recycled. When making the separating cut at the opening edge the knife 34 is applied to the tubular web 26 without the welding jaw 33. Having advanced the web by the intermediate section to be cut off, the knife 34 is again applied to the tubular web 26, but this time together with the welding jaw 33. Thus, the cut for separating the intermediate section and the formation of the transverse weld of the succeeding sack section are effected at the same time.

Above the welding jaws 33 and 35 a further clamping means is provided for clamping the tubular web 26. The same consists of a swivelling lever 39 provided with a clamping strip 38, which can be moved by means of a fluid piston cylinder unit 40. Firmly connected with the swivelling lever 39 is an arm bearing a roller 41, where the roller 41 in the clamping position of the swivelling lever 39 is disposed at a distance from a guide member 43. Said guide member 43 is connected with a lever 44, which is held in engagement with a stop 46 by means of a spring 45. The pivot of the lever 44 lies on the axis of the advancing roller 47. It has a downwardly pointing projection, which constitutes a counterpart 48 for the clamping strip 38. For releasing the clamping, after forming a bottom seam and making a separating cut, there are first of all actuated the fluid piston cylinder units 37 and 40, and as a result the coupling rods 28, 36 as well as the lever 39 are swivelled away. During this movement the roller 41 gets in contact with the cam surface of the guide member 43. This leads to a swivelling of the counterpart 48 in the direction of arrow C, so that on the one hand the end of the web 26 freely hanging down is released from the welding jaw 33 and is deflected on the other hand. Due to this deflection it is ensured that the web does not collide with the support 30, when in the next cycle it is advanced by the advancing rollers 47 and 51 by one sack length.

To furthermore prevent that the web 26 can wrap around the advancing rollers 47 and 41, the advancing rollers are provided with annular grooves 49, 50 in which engage stripping fingers 52 and 53. Of these fingers, the fingers 52 are stationarily held, and the fingers 53 are attached to the counterpart 48 as stripping rakes.

What is claimed is:

1. A method for manufacturing, filling and sealing sacks made from a tubular film web of thermoplastic material provided with side folds and printed in format print, where a leading end of the tubular film web is provided with a transverse weld, and from the tubular film web a section constituting an open sack is cut off, and where the sack is then filled to a filling level of the sack and the open end of the sack is pulled taut and closed by a transverse weld, said method comprising:

varying tubular film web section length corresponding to the filling level of the sack, intermittently advancing the tubular film web up to a printed mark after forming the transverse weld sealing the sack, cutting off a section constituting the sack by means of a separating cut without at the same time forming a transverse weld sealing a succeeding tubular section, advancing the succeeding section of the tubular film web by a comparatively short adjustable length, and forming a transverse weld sealing the succeeding tube section for forming a succeeding open sack.

2. A method according to claim 1, wherein the advance of the tubular film web after cutting off the sack section can be set at zero, and cutting off the sack section and forming the transverse weld of the succeeding sack section at the same time.

3. A method according to claim 1 further comprising cutting off a portion of the advanced comparatively short adjustable length of the tubular film web.

4. A method for manufacturing, filling and sealing sacks made from a tubular film web of thermoplastic material provided with side folds and printed in format print, where a leading end of the tubular film web is provided with a transverse weld, and from the tubular film web a section constituting an open sack is cut off, and where the sack is then filled to a filling level of the sack and the open end of the sack is pulled taut and closed by a transverse weld, said method comprising:

varying tubular film web section length corresponding to the filling level of the sack, intermittently advancing the tubular film web up to a printed mark after forming the transverse weld sealing the sack, cutting off a section constituting the sack by means of a separating cut without at the same time forming a transverse weld sealing a succeeding tubular section, advancing the succeeding section of the tubular film web by a comparatively short adjustable length, and forming a transverse weld sealing the succeeding tube section for forming a succeeding open sack, comprising additionally welding corners of the sections constituting the sacks, wherein welding of corners at an opening edge of the sack section and at a bottom seam of the sack section is each effected by means of a separate corner welding tool.

5. A method according to claim 4 wherein all corner welds are made at the same time as the transverse weld sealing the succeeding tube section.

6. A method according to claim 4, wherein the welding of corners at the opening edge of the sack section is made at the same time as the separating cut, and welding of corners at the bottom seam is made at the same time as the transverse weld. corner welding tools is automatically adjustable.

7. A method according to claim 4, wherein distance between the separate corner welding tools is automatically adjustable.

* * * * *